US012702918B1

(12) United States Patent
Noeldner

(10) Patent No.: US 12,702,918 B1
(45) Date of Patent: Aug. 11, 2026

(54) GAME STRUCTURE APPARATUSES

(71) Applicant: RIZZL LLC, Green Bay, WI (US)

(72) Inventor: Race Noeldner, Oneida, WI (US)

(73) Assignee: RIZZL LLC, Green Bay, WI (US)

( * ) Notice: Subject to any disclaimer, the term of this patent is extended or adjusted under 35 U.S.C. 154(b) by 0 days.

(21) Appl. No.: 19/073,458

(22) Filed: Mar. 7, 2025

(51) Int. Cl.
*A63F 9/08* (2006.01)

(52) U.S. Cl.
CPC ..... *A63F 9/0807* (2013.01); *A63F 9/083* (2013.01); *A63F 9/0876* (2013.01)

(58) Field of Classification Search
CPC ..... A63F 9/0807; A63F 9/083; A63F 9/0876; G09F 11/025
USPC ..... 273/153 S
See application file for complete search history.

(56) References Cited

U.S. PATENT DOCUMENTS 935,258 A * 9/1909 Immer ..... G09B 1/20 273/281
1,636,371 A * 7/1927 Kenney ..... A63F 9/0819 434/96
1,889,976 A * 12/1932 Comins ..... B44F 11/04 434/96
1,995,154 A 3/1935 Morrison
2,500,263 A * 3/1950 Pascoo ..... A63F 3/0423 434/96
2,581,492 A * 1/1952 Lowe ..... G09B 1/30 446/151
3,410,011 A * 11/1968 Bowman ..... G09F 9/37 273/281
3,462,857 A * 8/1969 Barlow ..... G09B 1/20 273/281
6,029,974 A * 2/2000 Povitz ..... A63H 33/086 273/156
6,881,066 B1 * 4/2005 Sarconi ..... G09B 1/18 273/153 S
7,784,792 B2 * 8/2010 Davis ..... A63F 3/00 273/287
7,861,926 B2 * 1/2011 Sheldon ..... G07F 7/086 235/487
10,166,464 B2 * 1/2019 Todokoro ..... A63F 9/08
2005/0206080 A1 * 9/2005 Chuang ..... A63F 9/12 273/157 R (Continued)

FOREIGN PATENT DOCUMENTS

GB 144507 A 6/1920
JP H06190143 A 7/1994

OTHER PUBLICATIONS

PCT/US2026/017923, International Search Report and Written Opinion, dated May 27, 2026, 26 pages.

*Primary Examiner* — Jeffrey S Vanderveen
(74) *Attorney, Agent, or Firm* — Andrus Intellectual Property Law, LLP

(57) ABSTRACT

A game structure apparatus includes a plurality of blocks with each block having a plurality of block faces, a first set of block faces of the plurality of block faces collectively have an image thereon and the first set of block faces can be oriented relative to each other to thereby form the image, a plurality of support members, the plurality of support members support the plurality of blocks and permit the plurality of blocks to be moved along and rotated about the support members such that the first set of block faces form the image, and a frame coupled to the plurality of support members.

12 Claims, 10 Drawing Sheets

(56) References Cited

U.S. PATENT DOCUMENTS

2014/0239588 A1* 8/2014 Fry ..... A63F 9/0073
273/153 R
2018/0272230 A1 9/2018 Todokoro

* cited by examiner

GAME STRUCTURE APPARATUSES

FIELD

The present disclosure relates to game structures and specifically to game structure apparatuses with rotatable blocks, retention blocks, and support members used as puzzles.

BACKGROUND

Some conventional games are utilized as puzzles that are solved by moving game pieces.

SUMMARY

This summary is provided to introduce a selection of concepts further described below in the Detailed Description. This summary is not intended to identify key or essential features of the claimed subject matter, nor is it intended to be used to aid in limiting the scope of the claimed subject matter.

In certain examples, a game structure apparatus includes a plurality of blocks with each block having a plurality of block faces, a first set of block faces of the plurality of block faces collectively have an image thereon and the first set of block faces can be oriented relative to each other to thereby form the image, a plurality of support members, the plurality of support members support the plurality of blocks and permit the plurality of blocks to be moved along and rotated about the support members such that the first set of block faces form the image, and a frame coupled to the plurality of support members.

Optionally, the plurality of support members define an offset distance between each adjacent support member in the plurality of support members that is less than a face distance of one of the block faces. Optionally, rotation of one of the blocks in the plurality of blocks is permitted by moving the one of the blocks along the corresponding support member. Optionally, a plurality of retention blocks coupled to one of the plurality of support members, and wherein the plurality of retention blocks are nonrotatable. Optionally, the frame comprises two or more frame sides. Optionally, each frame side comprises a plurality of support members and a plurality of blocks. Optionally, two frame sides are oriented in opposite directions. Optionally, the frame comprises six frame sides that form a cube. Optionally, a second set of block faces of the plurality of block faces collectively have a second image thereon and the second set of block faces can be oriented relative to each other to thereby form the second image. Optionally, the image can be overlaid with an alternative image. Optionally, a plurality of legs such that each leg connects to two support members of the plurality of support members, and the blocks can move along the leg between the two support members.

In certain examples, a method of operating a game structure apparatus includes moving a first block along a support member until the first block is sufficiently distant from a second block such that the first block can be rotated about the support member, rotating the first block about the support member until a desired block face of the first block is visible, and further moving the first block along the support member until the first block abuts a third block.

Optionally, the game structure apparatus includes a frame side including a plurality of rows of blocks with each row of blocks spaced apart from each other at an offset distance and the offset distance being is less than a maximum radial diameter required for rotation of one of the blocks in each row of blocks. Optionally, the first block is rotated subsequent to movement of the first block along the support member. Optionally, moving a retention block along a second support member. Optionally, the retention block is nonrotatable. Optionally, preventing the first block from rotating. Optionally, the game structure apparatus includes two or more frame sides. Optionally, each frame side comprises a plurality of support members and a plurality of blocks. Optionally, two frame sides are oriented in opposite directions.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1:
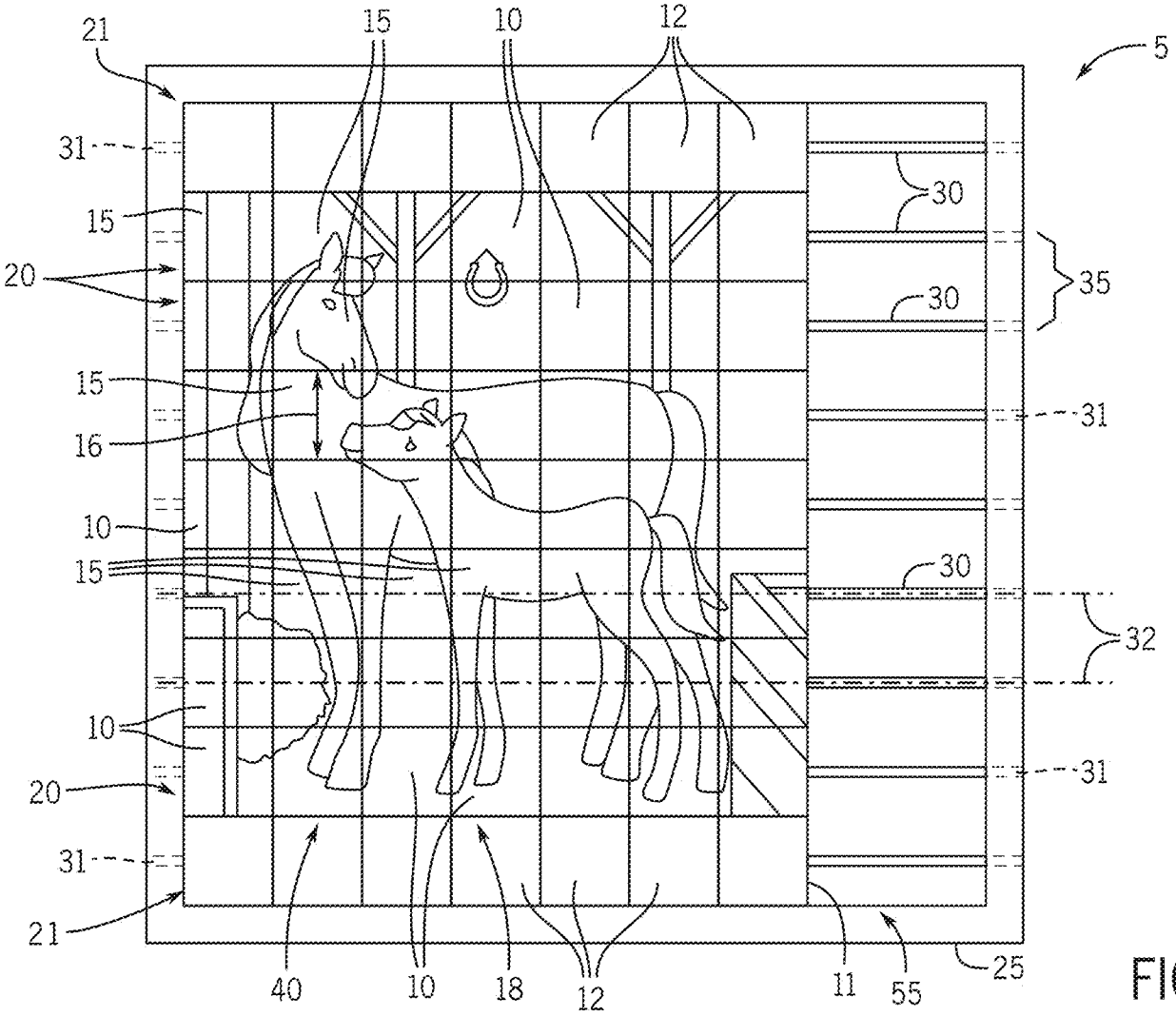
FIG. 1 is a perspective view of an example game structure apparatus according to the present disclosure.

Through observation, the present inventor recognized that conventional games, such as puzzles, can be prone to the risk of losing at least one game piece and being unable to complete the puzzle. Depending on the size and complexity of the conventional puzzle, the number of puzzle pieces may vary from 50 to 1000, as exemplary numbers. In addition to ensuring the puzzle pieces remain with the conventional puzzle, progress on assembling a conventional puzzle is often restricted to a flat surface large enough for the entire assembled puzzle. This means that portability of a conventional puzzle after the assembly has begun, becomes nigh unto impossible. Sometimes these challenges are further complicated when, either due to the difficulty or the length of time required to finish a conventional puzzle, users seek a second or third conventional puzzle to attempt rather than finish assembling the image of the current conventional puzzle.

Accordingly, the inventor developed the example game structure apparatuses of the present disclosure that are improved games over conventional games and advantageously retain puzzle pieces. As will be described in greater detail herein below, some example game structure apparatuses of the present disclosure include puzzle pieces that are blocks connected to support members that are, in turn, attached to the frame of the game structure. Such a configuration prevents the loss of any puzzle pieces and allows for transportability. The blocks are positioned within the frame at a distance that is close enough to make a unified, single image, despite the larger size of the blocks compared to some puzzle pieces. However, such proximity provides a second benefit, wherein the blocks cannot rotate when placed so closely together. This means that any progress on a puzzle can be saved without fear of unforeseen objects disrupting the progress of the puzzle during its assembly. In addition, some example game structure apparatuses of the present disclosure include one or more images on at least one of the block faces that match the other portions of the same image that are on the other blocks in the game structure apparatuses. When the portion of the image on each block in the game structure apparatus is displayed, the puzzle is complete and the full image is visible. Some game structure apparatuses have several different puzzles, with portions of different images on each side of each block within the game structure. The example game structure apparatuses of the present disclosure can include multiple puzzles or images that can be created by the user. In addition, the example game structure apparatuses of the present disclosure can have varying levels of difficulty based on the different sizes and shapes of components (e.g., size of the frame, the size of the blocks), image/pattern intricacies, and level of differentiation from each image. For instance, if each block face is a different color and the blocks are large, it would be much easier to distinguish the correct block face than if the blocks were smaller with similar colored images on each side that were more difficult to distinguish from one another. The example game structure apparatuses can help develop and maintain fine motor skills, color/image recognition, and problem-solving and further promote a sense of accomplishment, mental stimulation, and stress relief.

FIG. 1 depicts an example game structure apparatus 5 comprising a plurality of blocks 10 within a frame 25. The single lines between the blocks 10 represent the edges of the blocks 10. Each block 10 has a plurality of block faces 15. Note that the size and the shape of the blocks 10 can vary, and in the example depicted in FIG. 1, the blocks 10 are cubes. In other examples, the blocks 10 can be prisms (e.g., hexagonal prisms, pentagonal prism, combination of different prisms to create a tessellation), cuboids, and/or the like with a plurality of block faces 15. Further note that the blocks 10 can be formed of any suitable material such as wood, plastic, rubber, paper, metal, ceramic, textiles, glass, and/or the like.

Each block face 10 has portions of an image 40 thereon, and a first set of block faces 18 of the plurality of block faces 15 collectively form the image 40 when the block faces 15 in the first set of block faces 18 are oriented in the same direction and relative to each other. The image 40 can be indicia, a logo, a picture, a drawing, a painting, a photo, and/or the like. The image 40 can be applied or coupled to the block faces 15 in any suitable manner such as adhesive sticker-like units overlaid on the block faces 15, painting the image 40 on the block face 15, integrally forming the image 40 with the blocks 10 when the blocks 10 are formed, etching the image 40 into the block faces 15, and/or the like. In one specific example, a complete image 40 with adhesive backing is overlaid onto the plurality of blocks 10. The image 40 is then cut with a knife at all the seams between the individual blocks 10 thereby separating the image 40 into portions on the individual block faces 15. The blocks 10 can then be moved independently of each other. Note that in some examples, the image 40 can be removed from the blocks 10 and replaced with a different image. In still other examples, a new alternative image (not depicted) can be overlayed over to cover the original image 40. As such, the new alternative image can change and update the game structure apparatus 5 as needed or desired by the user. Other images might include texturization such as extended ridges or recessed surfaces on the block face 15 that form a three-dimensional image, such as a contoured landscape or a texturized image. For example, FIG. 1 depicts the first set of block faces 18 with each block face 15 containing a portion of an image 40 of a farm scene of a horse and a foal. When all the block faces 15 of the first set of block faces 18 are properly aligned relative to each other and toward the user of the game structure apparatus 5, the image 40 of the farm scene is visible. Each block face 15 has a face distance 16 that is equal to or greater than an offset distance 35 (described below). In the example depicted in FIG. 1, the blocks 10 also include a second set of block faces (not depicted) that when the corresponding block faces 15 are aligned toward the user of the game structure apparatus 5 a second image is visible, a third set of block faces (not depicted) that when the corresponding block faces 15 are aligned toward the user of the game structure apparatus 5 a third image is visible, and a fourth set of block faces (not depicted) that when the corresponding block faces 15 are aligned toward the user of the game structure apparatus 5 a fourth image is visible.

Each block face 15 of each block 10 can have a portion of a different image or depiction. For example, each block 10 depicted in FIG. 1 has three additional block faces 15 and each additional block face 15 has a portion from three different images 40, e.g., a winter scene with a snowman, a flower scene with a butterfly, and a forest scene with mushrooms. The blocks 10 thereby include a second set of block faces for collectively displaying a second image, a third set of block faces for collectively displaying a third image, and a fourth set of block faces for collectively displaying a fourth image. Each block 10 is rotated (described further herein) such that the different sets of block faces 18 and the images are visible to the user. In other examples, one or more of the block faces 15 can be devoid of the image (e.g., the block face 15 is blank). In these examples, the game structure apparatus 5 may be utilized as a simplified puzzle for young children where coordinating a single image may be a sufficient configuration.

Figure 2:
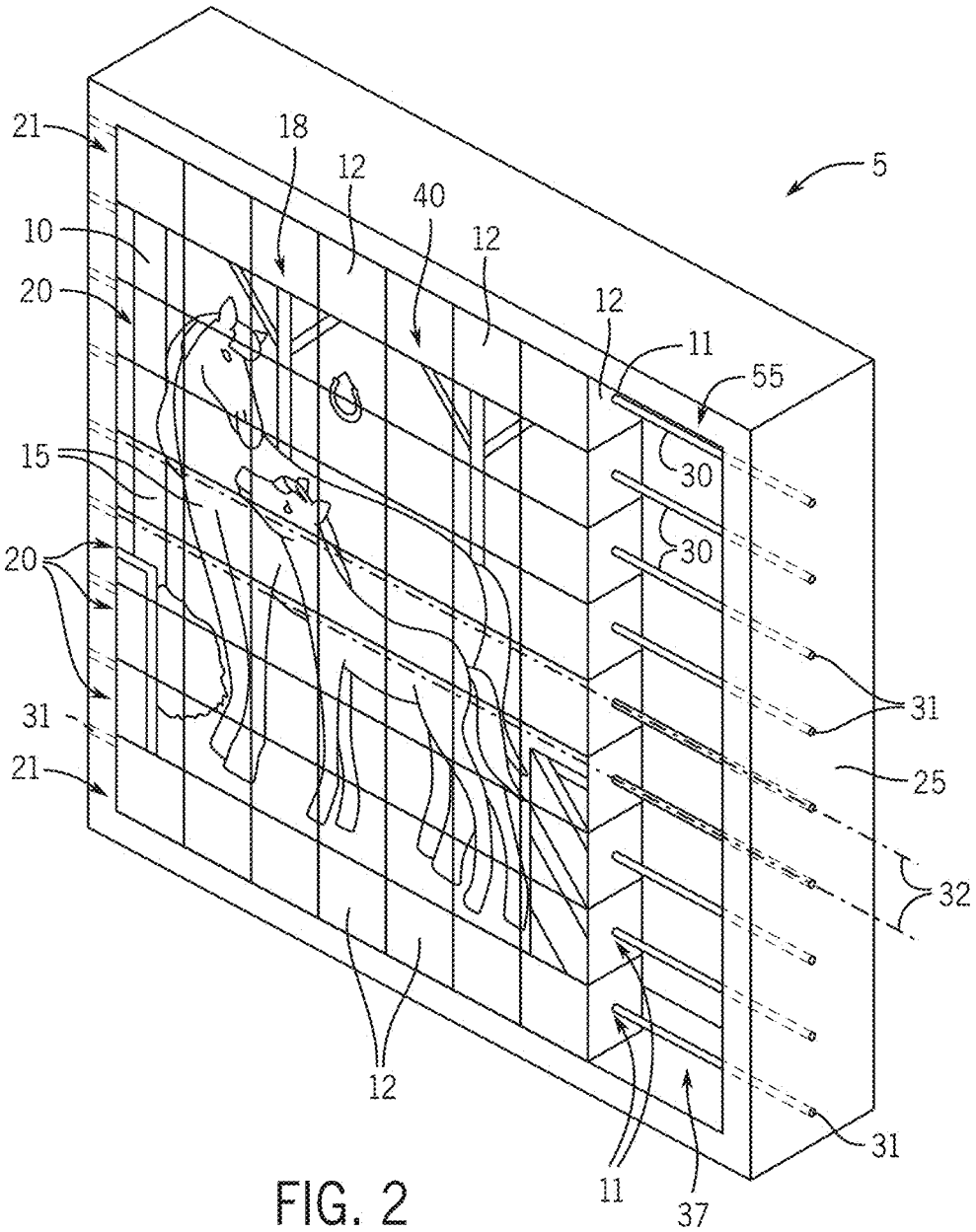
FIG. 2 is another perspective view of the game structure apparatus of FIG. 1.

As depicted in FIGS. 1-2, the blocks 10 are arranged into columns or rows 20 within the frame 25. Each block 10 has a bore 11 through which a support member 30 extends, and accordingly, the blocks 10 are movably and/or rotatably coupled to a support member 30. Each support member 30 has a pair of opposing support member ends 31 which are each coupled to the frame 25. The frame 25 acts as a 'stop' retain the blocks 10 on the support members 30 and prevent the blocks 10 from inadvertently decoupling from the support members 30. In the example depicted in FIGS. 1-2, one of the support members 30 has seven blocks 10 coupled thereto. The support members 30 can be any shape and size, and in the example depicted in the FIGS. 1-2, the support members 30 are straight rods that each extend along an axis 32. In other examples the support members 30 are cables, dowels, rope, string, fishing line, pipe cleaner, pipes, and/or the like. The support members 30 and the axes 32 extend parallel to each other. The depth of the frame 25 can also be sized to prevent the blocks 10 from contacting a supporting surface (e.g., table) when the game structure apparatus 5 is placed flat on the supporting surface. In certain examples, the frame 25 includes identifying markings (not depicted; bar code, QR code) that allows the user to identify the images 40 of the game structure apparatus 5 via scanning with a mobile phone to access an electronic database that contains electronic files of the images.

The blocks 10 that are connected to the support members 30 to form a column or a row 20, depending on the orientation of the game structure apparatus (e.g., FIGS. 1-2 the support members 30 horizontally extend when the frame 25 is on the bottom side or the back side; the support members 30 vertically extend when the frame 25 is on the left or right sides).

The spacing of the support members 30 relative to each other can be configured such that each block 10 can abut adjacent blocks 10. The offset distance 35 between the support members 30 illustrated in FIG. 1 may be far enough apart that translational movement along the length of the support member 30 is possible, but the stationary rotation of the block 10 without axial movement along the length of the support member 30 is restricted. In one example, the blocks 10 are 1.0 inch by 1.0 inch cubes and the distance is 1.0 inches. As the example block 10 is rotated about the axis 32 of the support members 30 the block 15 has a rotational distance of 1.414 inches (e.g., the rotational distance is maximum radial diameter of the block 10 between two edges through the center bore and the rotational distance can be visualized by looking at the end view of the block such that a hypotenuse extends between two edges of the block), which is less than the allotted 2.0 inch cavity. The size of the bores 11 in the blocks 10 should correspond or be similar to the diameter of the support member 30 to thereby prevent 'play' between the block 10 and the support member 30. In another example, the supporting member 30 has a diameter of ⅛ inch and the bore has a diameter of 5⁄32 inch.

In certain examples, the game structure apparatus 5 includes one or more retention columns or rows 20 with a plurality of retention blocks 12. In these examples, a support member 30 extends through the retention blocks 12 and the retention blocks 12 are positioned along the frame 25. Note that in other examples, the retention blocks 12 are coupled to the frame 25 via a tongue and groove connection and/or other methods for coupling the retention blocks 12 are coupled to the frame 25 (e.g., screws, adhesives).

In certain examples, the retention blocks 12 are located above and below the blocks 10 with the indicia thereon. The retention blocks 12 do not have indicia thereon and do not contribute to completing the image 40 displayed on the block faces 15 of the other blocks 10. Note that in other example, the retention blocks 12 have portions of the image thereon or other indicia not associated with the image 40. For example, the upper row of retention blocks 12 could have images of blue clouds thereon and lower row of retention blocks 12 could have images of green grass thereon.

An example operational sequence for engaging and playing with the game structure apparatus 5 depicted in FIGS. 1-2 is described in greater detail herein below with reference to FIGS. 3-5.

Figure 3:
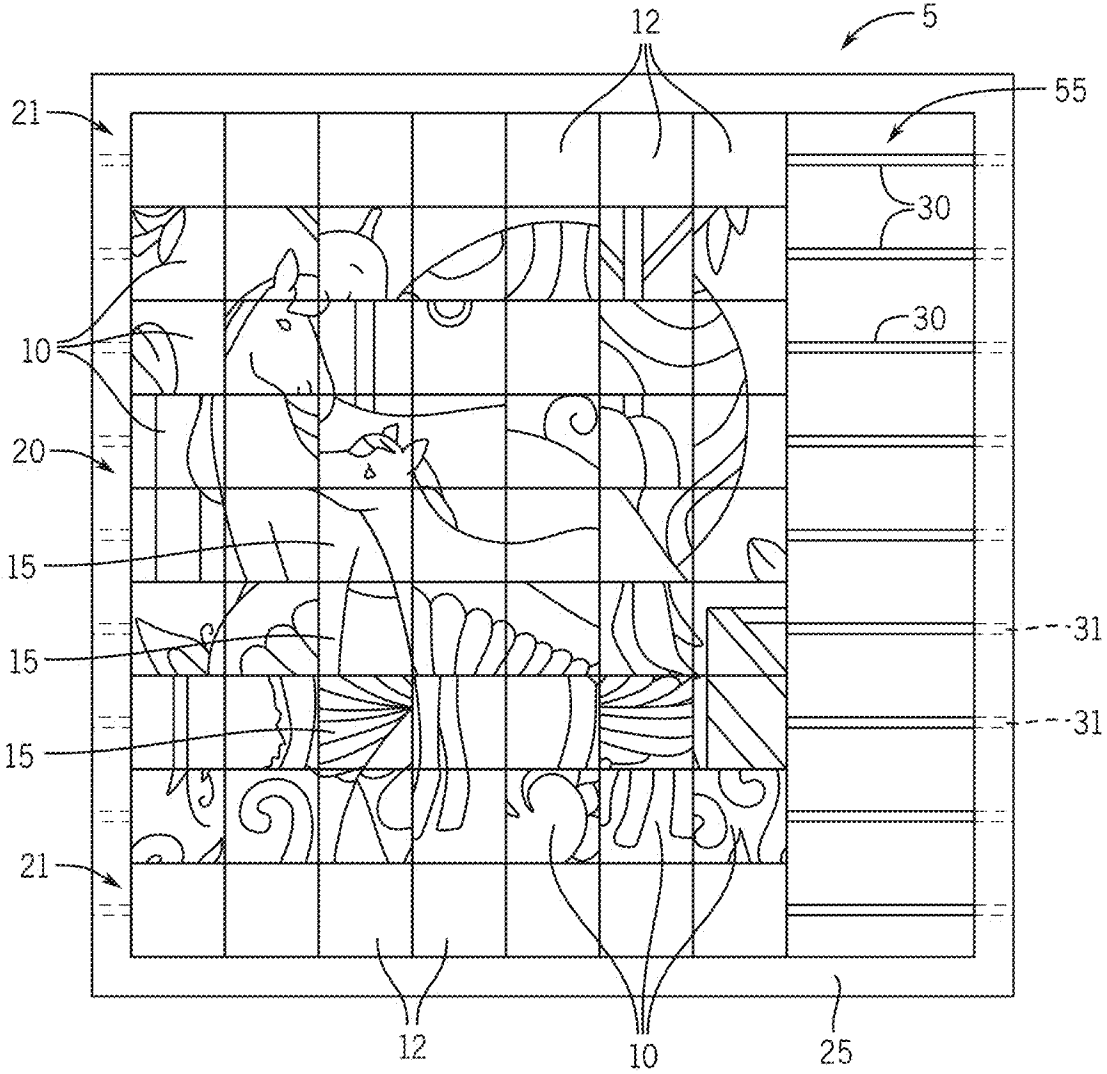
FIG. 3 is a top-down plan view of the game structure apparatus of FIG. 1 with a plurality of blocks displaying portions of different images.

FIG. 3 depicts the game structure apparatus 5 in a jumbled configuration in which the images on the block faces 15 are not aligned and thereby a complete image 40 (e.g., the farm scene depicted on FIG. 1) is not visible to the user. A complete set of block faces 18 is not oriented toward the user. Instead, FIG. 3 depicts portions of several different images 40 on the block faces 15. To form a complete image 40, the user must rotate each block 10 such that a complete set of block faces (which collectively have the image 40) is oriented toward the user.

The user uses their hand to engage one of the blocks 10 in one the rows 20 and move (e.g., slide; see arrows on FIG. 4) the block 10 along the support member 30 into position which the block 10 can be rotated above the axis 32. For example, the block 10 is moved into a length of the support member 30 without adjacent blocks 10 (see exemplary location 55 where the block 10 can be rotated.) Note that when the blocks 10 are next to adjacent blocks 10, such as the original positions of the blocks 10 depicted in FIG. 3, the blocks 10 cannot be rotated above the axes 32.

Figure 4:
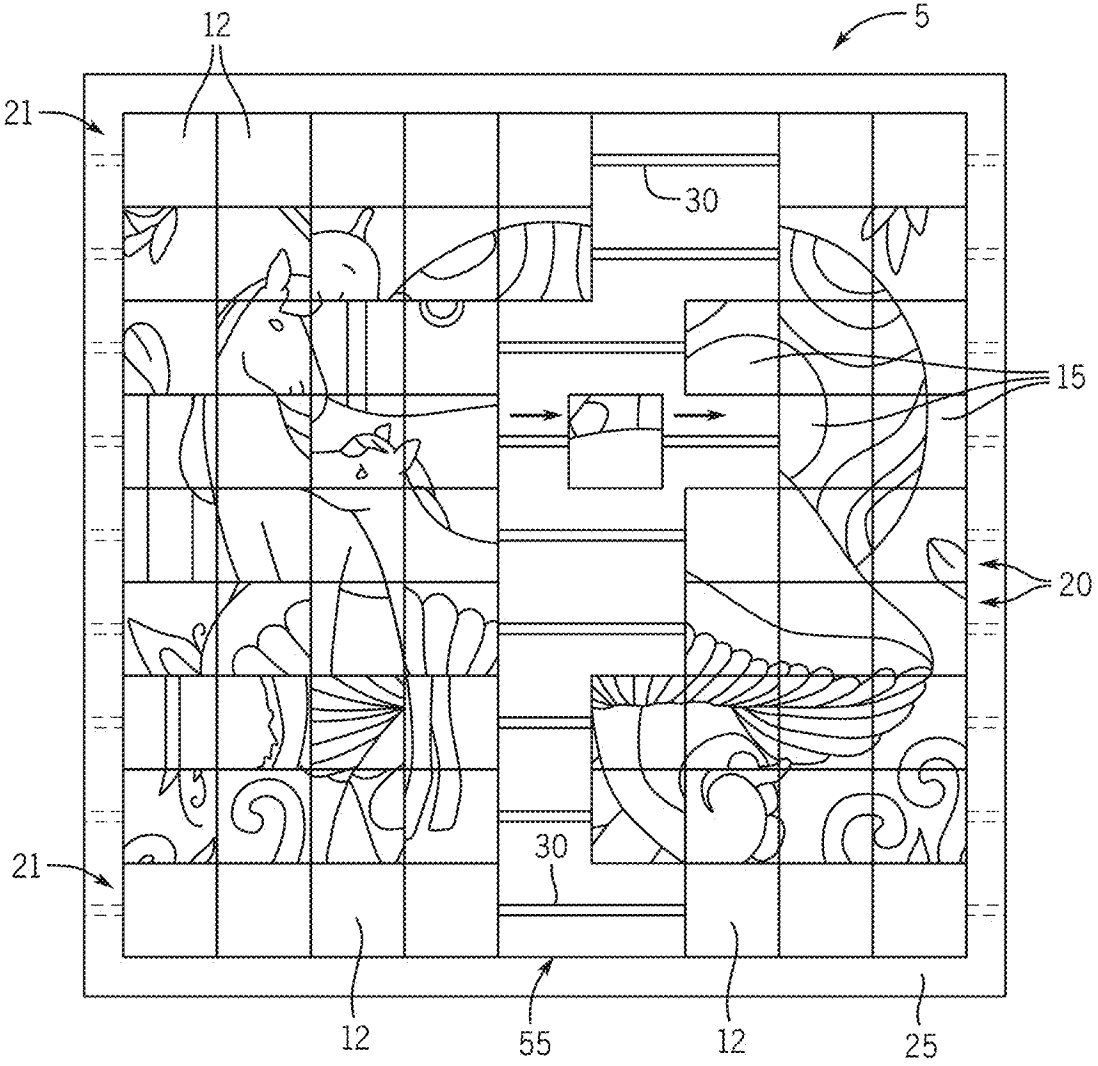
FIG. 4 is a view like FIG. 3 with a user orienting the blocks such that the blocks collectively begin to display an image.
Figure 5:
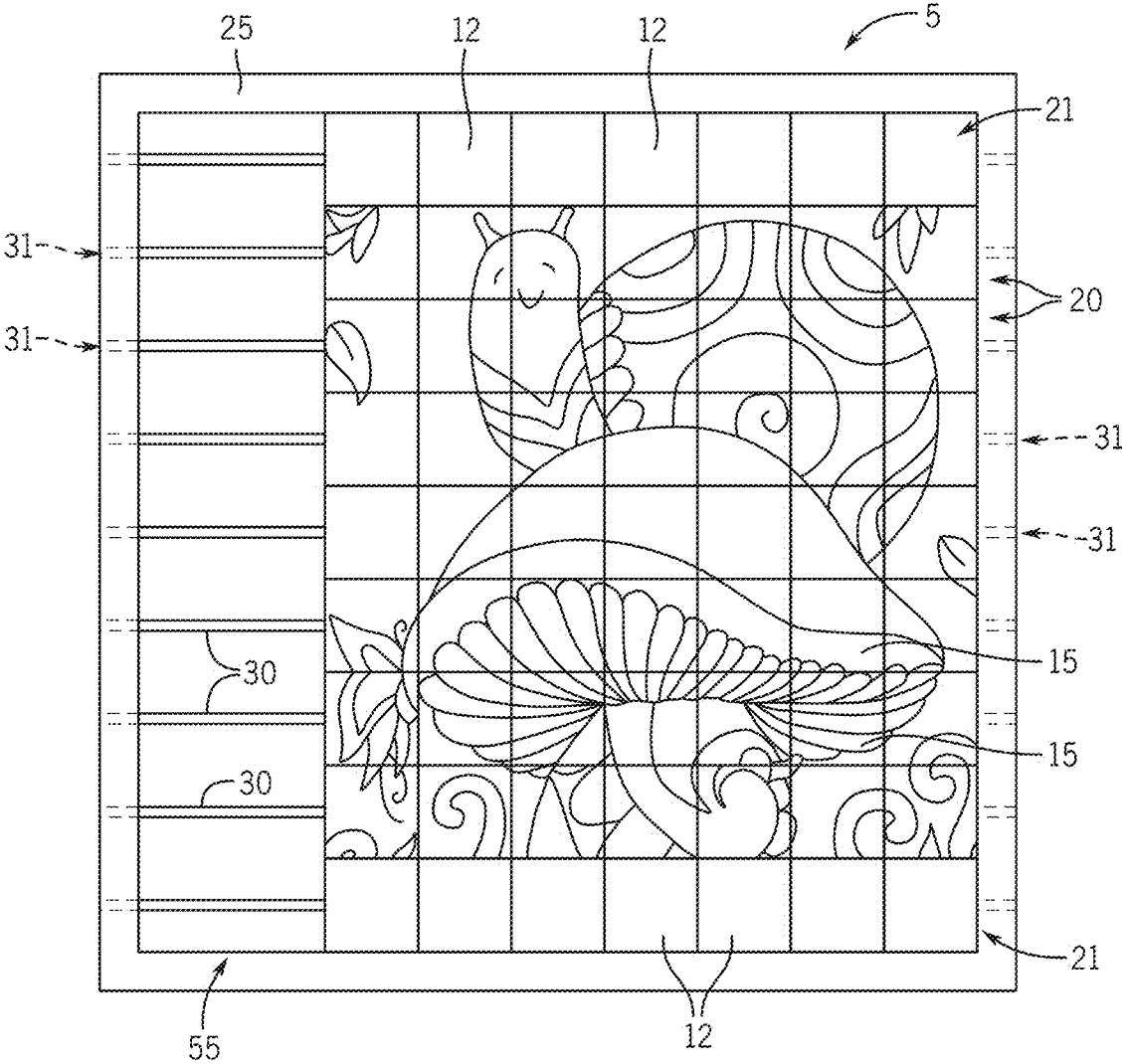
FIG. 5 is a view like FIG. 3 with the blocks displaying the image.

As depicted in FIG. 4, the user rotates the block 10 until the block face 15 with the portion of the desired image 40 is oriented toward the user and then moves the properly oriented block 10 adjacent to other properly oriented blocks 10. Accordingly, the desired image 40 on the block faces 15 begins to take form until a complete set of block faces 18 are oriented toward the user. Note that as the properly oriented blocks 10 are moved adjacent to one another, the location along the support members 30 (see exemplary location 55 wherein the blocks 10 can be rotated) changes. Further note, that as the properly oriented blocks 10 are moved adjacent to each other, the blocks 10 prevent each other from inadvertently rotating. This process is repeated with each block 10 until a complete second image 40 is displayed (as depicted in FIG. 5). Note that in this example, a second set of block faces 18 collectively displays the complete second image 40 (e.g., forest scene with mushrooms) in a direction toward the user while the first set of block faces 18 (e.g., see FIG. 1) have been rotated to face in a direction away from the user).

In certain examples, the retention blocks 12 are moved along the corresponding support members 30 as the other blocks 10 are rotated as noted above. The retention blocks 12 do not rotate as the frame 25 prevents rotation of the retention blocks 12. That is, the retention blocks 12 are along the top and bottom of the frame 25 may be axially moved along the corresponding support members 30 but rotation of the retention blocks 12 is restricted or prevented due to the proximity to the frame 25. The rotational restrictions of the retention rows 21 may ensure rotation of the remaining blocks 10 by offsetting any proximity to the frame that might otherwise restrict the rotation of blocks 10 that have a portion of the image 40 on a block face 15. In one example, the retention blocks 12 have a different size than the other blocks 10. In these examples, the retention blocks 12 may be of a different shape, and/or the size may include any combination of dimensions such as height, width, etc. Additionally, the proximity of the retention blocks 12 (and the retention row 21 by extension) may prevent undesired rotation of the remaining blocks 10 when the blocks 10 are stationary. For example, when in a configuration such as the one depicted, the retention rows 21 may prevent the top and bottom rows of image-containing blocks 10 from rotating and displaying a portion of an image 40 (or no image portion at all) that is not part of the image 40 depicted by the remaining blocks.

FIGS. 6-8 and 10 depict other example game structure apparatuses 5 according to the present disclosure. The example game structure apparatuses 5 depicted in FIGS. 6-8 and 10 can include one or more features (e.g., indicia on the blocks 10) and/or components (e.g., support members 30) described with reference to the other example game structure apparatuses 5 described above with respect to FIGS. 1-5. Similarly, the example game structure apparatuses 5 described with reference to FIGS. 1-5 can include any features and/or components described herein below with reference to the other example game structure apparatuses 5. Note that some components of the example game structure apparatuses 5 described with reference to FIGS. 6-8 and 10 that are similar to the components of the game structure apparatuses 5 described with reference to FIGS. 1-5 are denoted with the same part numbers, however, it should be understood that the use of the same part numbers for features and/or components of the present disclosure should not be construed to indicate that the similarly marked systems and/or components are necessarily identical. Instead, the similarly marked systems and/or components may have varying features or characteristics. For instance, the frame 25 depicted in FIG. 6 has a different shape and size than the frame 25 depicted in FIG. 1 and the game structure apparatus 5 depicted in FIG. 6 has fourteen rows of blocks 20 collectively on two face sides while the game structure apparatus 5 in FIG. 1 has seven rows of blocks 20 on one face side.

Figure 6:
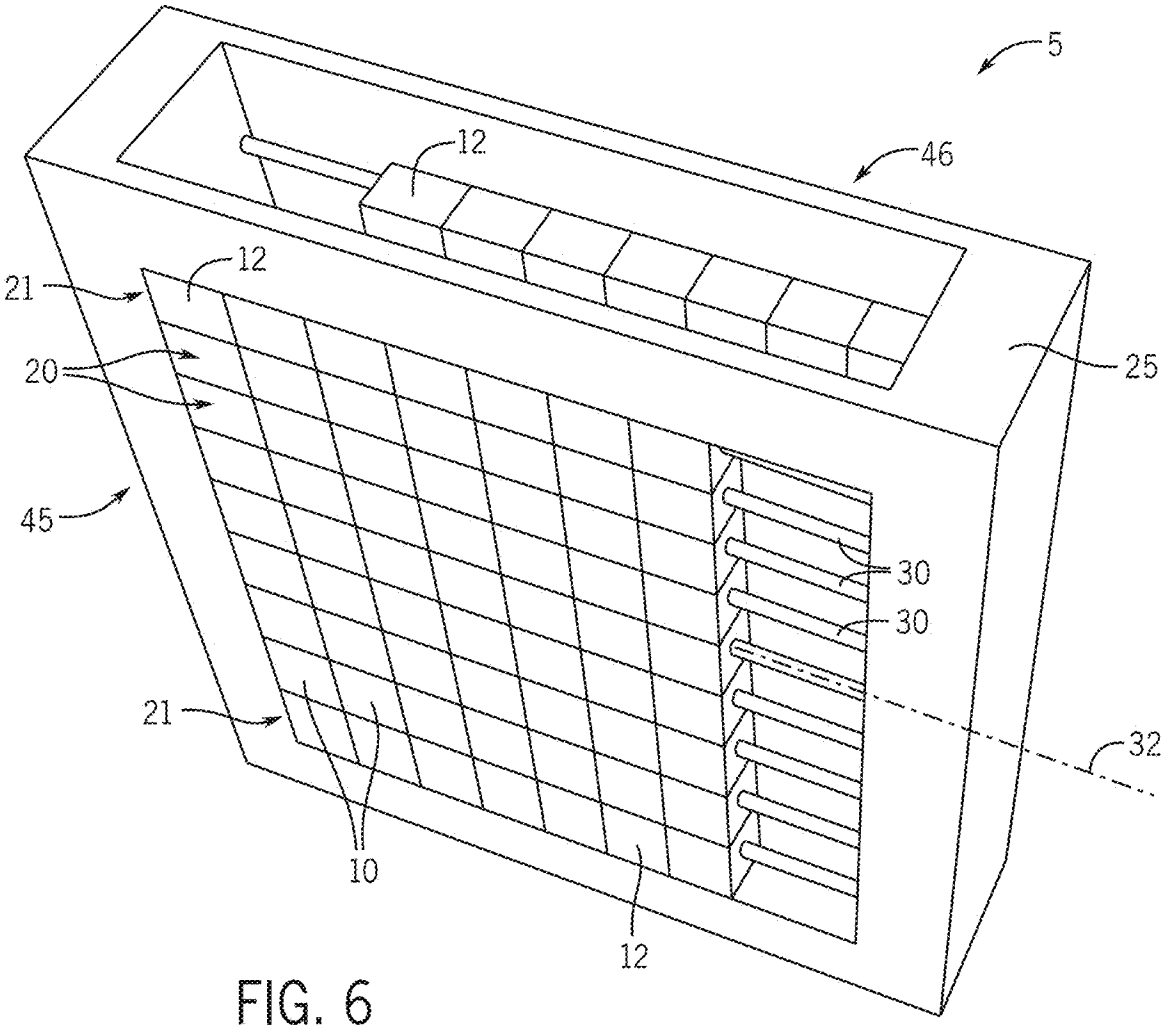
FIG. 6 is a perspective view of another example game structure apparatus according to the present disclosure.

The example game structure apparatus 5 depicted in FIG. 6 includes a frame 25 having a frame 25 with two or more frame sides 45, 46. Each frame side 45, 46 faces in opposite outward directions to provide two locations to which one or more support members 30, a plurality of blocks 10, and/or a plurality of retention blocks 12 are coupled. The blocks 10 within each frame side 45, 46 may have portions of separate images 40 on their respective block faces 15. In this example, the completed images 40 of the first frame side 45 can be different than the images 40 displayed on the block faces 15 of the second frame side 46.

Figure 7:
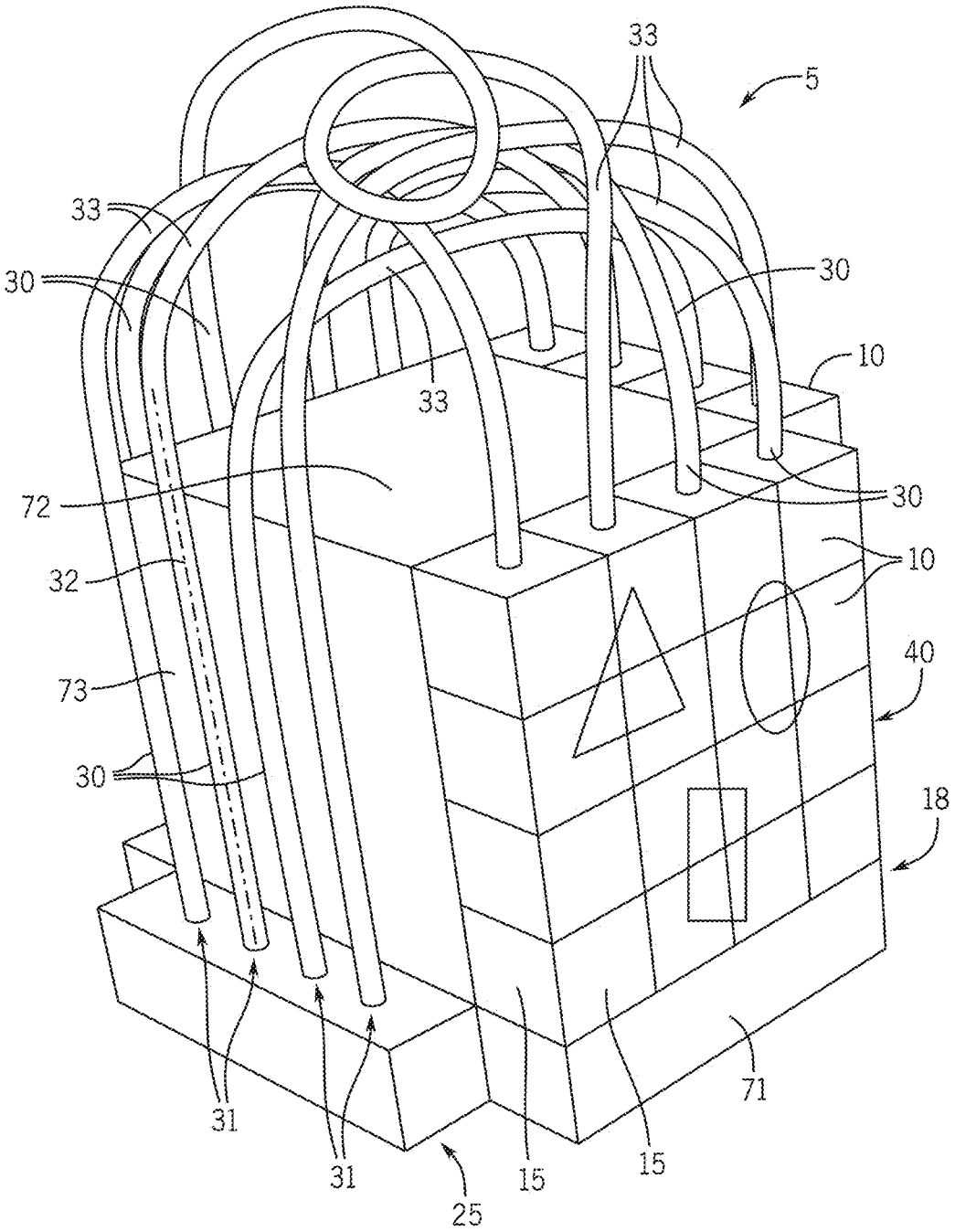
FIG. 7 is a perspective view of another example game structure apparatus according to the present disclosure.

FIG. 7 depicts an example game structure apparatus 5 that includes a frame 25 having a frame 25 with six frame sides 45, 46, 47, 48, 49, 50. Each frame side 45-50 includes a plurality of blocks 10, a plurality of retention blocks 12, and a plurality of support members 30. The blocks 10 within each frame side 45-50 may have portions of separate images 40 on their respective sets of block faces.

Figure 8:
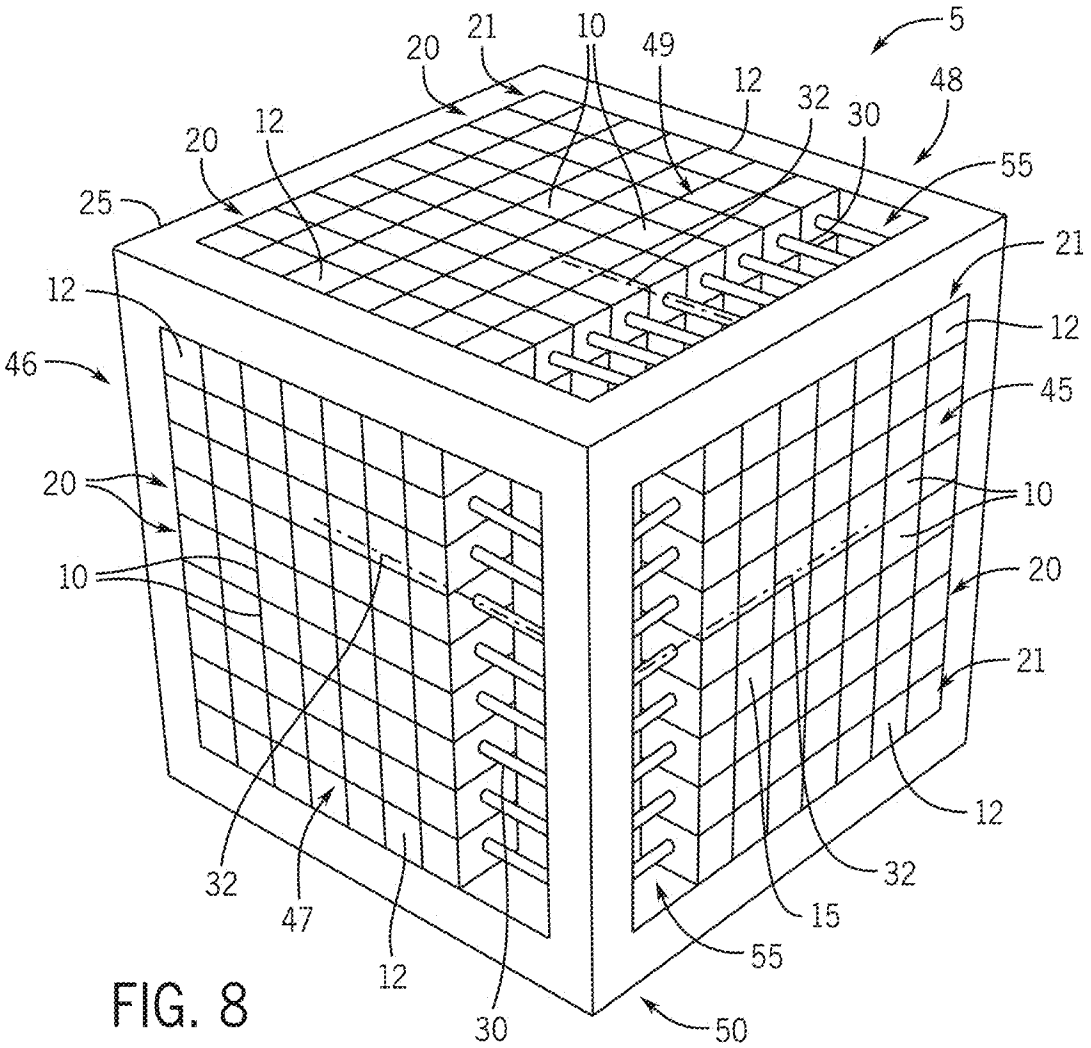
FIG. 8 is a perspective view of another example game structure apparatus according to the present disclosure.

The example game structure apparatus 5 depicted in FIG. 8 includes a frame 25 that has a base 71 and a center body 72. The center body 72 has a plurality of body surfaces 73 that face the support members 30 and the blocks 10. Each support member 30 extends axially from the base 71, and the free end 31 of the support member 30 is coupled to a leg 33. Each leg 33 extends over the body 72 and connects to the free end 31 on another support member 30. The leg 33 can be of any shape, and the leg 33 increases the difficulty of moving and rotating the blocks 10 to form images 40. In example, the blocks 10 form a first image 40 while along one of the sides of the center body 72 and can be moved and rotated along the support member 30, the leg 33, and another support member 30 to thereby form the same or different image 40 along another side of the body. Note that the body surfaces 73 prevent rotation of the blocks 10. As such, the user must move the blocks 10 along the legs 33 before the blocks 10 can be rotated.

Figure 9:
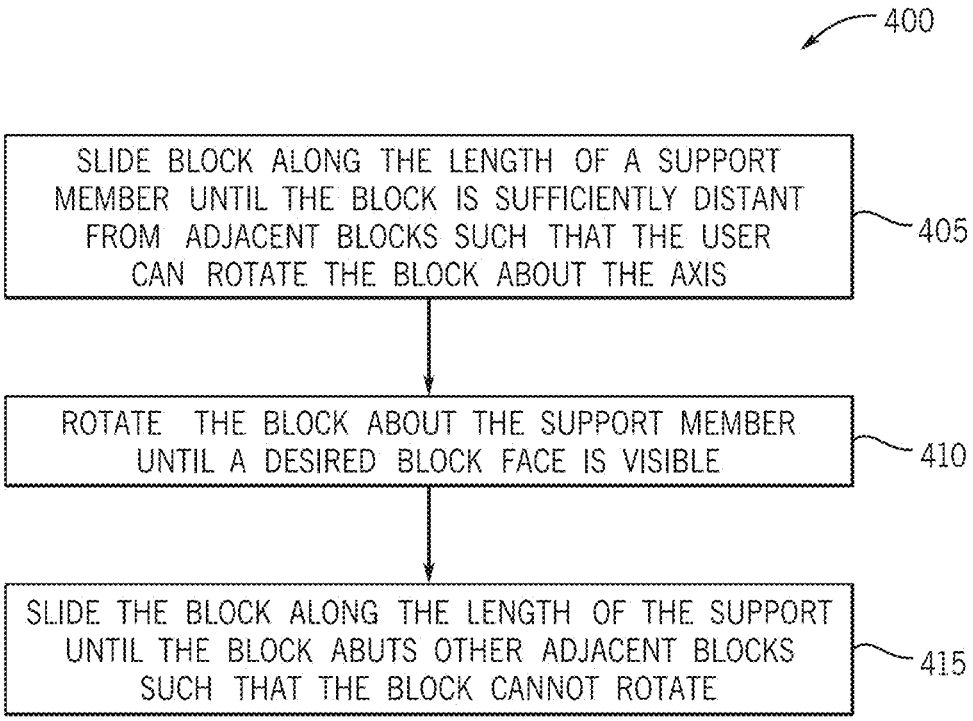
FIG. 9 is an example method for engaging a game structure apparatus according to the present disclosure.

FIG. 9 depicts exemplary method steps for operating an example game structure apparatus 5 (such as the game structure apparatus 5 depicted in FIGS. 1-2) according to the present disclosure. At 405, the user moves (e.g., slides) the block 10 slides along the length of a support member 30 until the block 10 is sufficiently distant from adjacent blocks 10 such that the user can rotate the block about the axis 32. The block 10 can be slid in any direction (e.g., a horizontal direction, a vertical direction), depending on the orientation of the support members 30. At 410, the user rotates the block 10 about the support member 30 until a desired block face 15 is visible. The desired block face 15 is the block face 15 that has the portion of the image 40 that matches the image 40 as displayed by the remaining blocks 10. The image 40 on the block face 15 may be two-dimensional or three-dimensional, wherein the portion of the image 40 may contain ridges and/or recesses in the surface of the block face 15. At 415, the user moves the block 10 along the length of the support member 30 until the block 10 abuts other adjacent blocks 10 such that the block 10 cannot rotate. Optionally, the user slides the block 10 back into the original position it began from, except that the desired block face 15 is facing the user. These steps may be repeated for each block 10 within the frame side 45 until the desired block faces 15 collectively form the image 40. These steps may be repeated for one or more blocks 10 in their entirety or in part. For example, to rotate a block 10 in the middle of a row, the two blocks 10 to the right of the desired block 10 and the desired block 10 itself may be moved into the open portion of the support member 30 to allow the desired block to be rotated. When returning the block 10 to the remainder of the blocks 10, all three blocks 10 may slide along the length of the support member 30 to return them to the image 40 displayed on the block faces 15.

Figure 10:
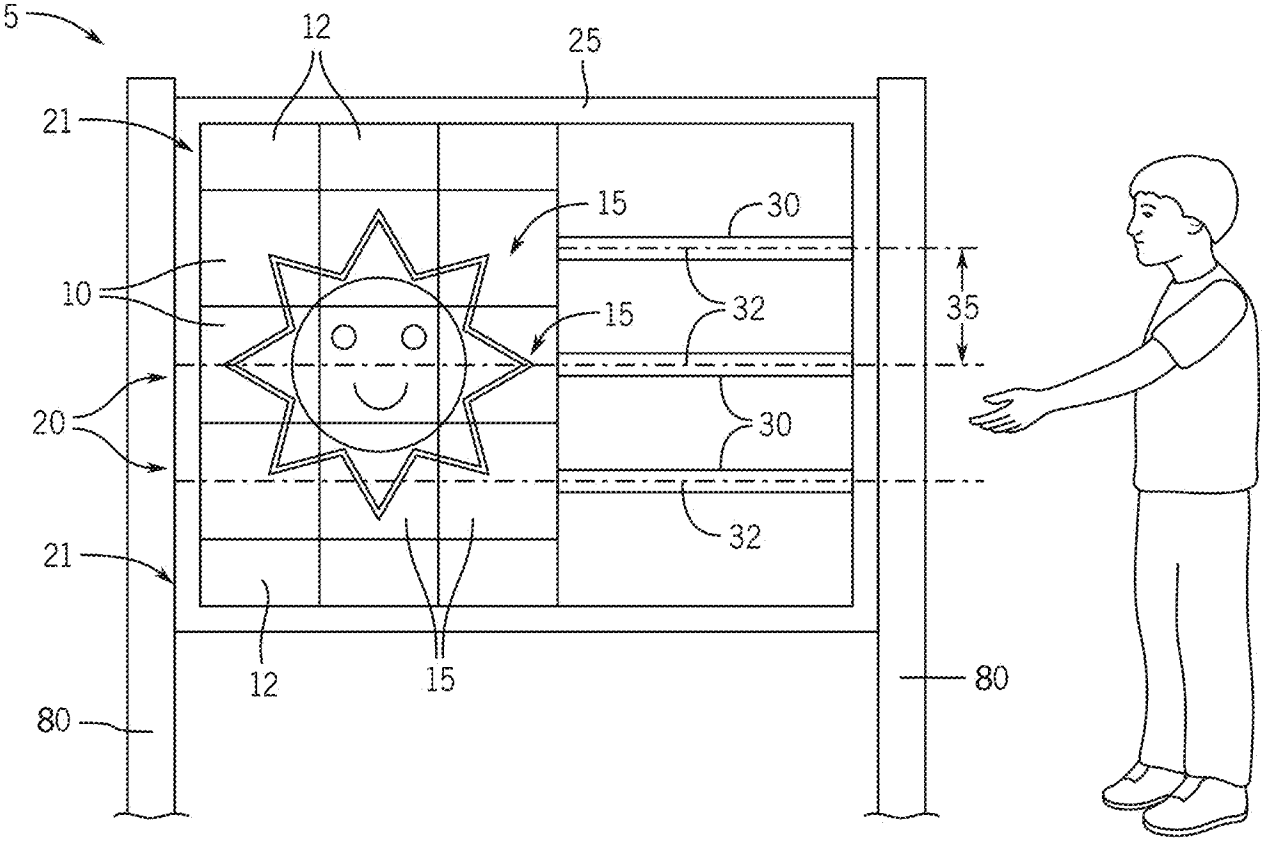
FIG. 10 is a perspective view of another example game structure apparatus according to the present disclosure.

FIG. 10 depicts another example game structure apparatus 5 according to the present disclosure. The example game structure apparatus 5 is utilized on a playground or other outdoor space allowing people walk up and engage the game structure apparatus 5. The frame 25 is vertically supported on the ground with one or more posts 80. The blocks 10 and the retention blocks 12 of this example game structure apparatus 5 larger than the blocks 10 and the retention blocks 12 for tabletop sized game structure apparatus 5 (such as the example game structure apparatuses 5 described above with reference to FIGS. 1-5). The first set of block faces 18 of the plurality of blocks 10 form an image of a sun when the first set of block faces 18 are orientated toward the user. Note that in the example depicted, the retentions blocks 12 partially extend between the sides of the frame 25, and in other examples, the retentions blocks 12 will fully extend between the sides of the frame 25. In one example, the blocks 10 are 1.0 foot cubes and the face dimensions of the retention blocks 12 are 1.0 foot by 0.5 foot. The support member 30 support the blocks 10, 12, and in one example, the support members are 2.0 inch diameter pipes.

In certain examples, a game structure apparatus includes a plurality of blocks with each block having a plurality of block faces, a first set of block faces of the plurality of block faces collectively have an image thereon and the first set of block faces can be oriented relative to each other to thereby form the image, a plurality of support members, the plurality of support members support the plurality of blocks and permit the plurality of blocks to be moved along and rotated about the support members such that the first set of block faces form the image, and a frame coupled to the plurality of support members.

Optionally, the plurality of support members define an offset distance between each adjacent support member in the plurality of support members that is less than a face distance of one of the block faces. Optionally, rotation of one of the blocks in the plurality of blocks is permitted by moving the one of the blocks along the corresponding support member. Optionally, a plurality of retention blocks coupled to one of the plurality of support members, and wherein the plurality of retention blocks are nonrotatable. Optionally, the frame comprises two or more frame sides. Optionally, each frame side comprises a plurality of support members and a plurality of blocks. Optionally, two frame sides are oriented in opposite directions. Optionally, the frame comprises six frame sides that form a cube. Optionally, a second set of block faces of the plurality of block faces collectively have a second image thereon and the second set of block faces can be oriented relative to each other to thereby form the second image. Optionally, the image can be overlaid with an alternative image. Optionally, a plurality of legs such that each leg connects to two support members of the plurality of support members, and the blocks can move along the leg between the two support members.

In certain examples, a method of operating a game structure apparatus includes moving a first block along a support member until the first block is sufficiently distant from a second block such that the first block can be rotated about the support member, rotating the first block about the support member until a desired block face of the first block is visible, and further moving the first block along the support member until the first block abuts a third block.

Optionally, the game structure apparatus includes a frame side including a plurality of rows of blocks with each row of blocks spaced apart from each other at an offset distance and the offset distance being is less than a maximum radial diameter required for rotation of one of the blocks in each row of blocks. Optionally, the first block is rotated subsequent to movement of the first block along the support member. Optionally, moving a retention block along a second support member. Optionally, the retention block is nonrotatable. Optionally, preventing the first block from rotating. Optionally, the game structure apparatus includes two or more frame sides. Optionally, each frame side comprises a plurality of support members and a plurality of blocks. Optionally, two frame sides are oriented in opposite directions.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A game structure apparatus comprising:

a frame;

a plurality of substantially rigid support members that each extend along an axis and are coupled to the frame, wherein each support member in the plurality of support members includes a pair of support member ends coupled to the frame and a length that extends between the support member ends; and a plurality of blocks with each block in the plurality of blocks coupled to one of the plurality of support members and each block in the plurality of blocks including a plurality of block faces, wherein a first set of block faces of the plurality of block faces of the plurality of blocks can be oriented in the same direction to form an image; and wherein each block of the plurality of blocks is capable of moving along and freely rotating about the support member to which the block is coupled along the length of the support member until the block is adjacent to another block coupled to another support member.

2. The game structure apparatus according to claim 1, wherein the plurality of support members define an offset distance between each adjacent support member in the plurality of support members that is less than a face distance of one of the block faces.

3. The game structure apparatus according to claim 1, wherein each block has a circular bore and each support member has a circular cross-section such that each block rotates about the support member to which the block is coupled when the block does not contact another block coupled to another support member.

4. The game structure apparatus according to claim 1, further comprising a plurality of retention blocks coupled to one of the plurality of support members, and wherein the plurality of retention blocks are nonrotatable.

5. The game structure apparatus according to claim 1, wherein a second set of block faces of the plurality of block faces collectively have a second image thereon and the second set of block faces can be oriented relative to each other to thereby form the second image.

6. The game structure apparatus according to claim 1, wherein the image can be overlaid with an alternative image.

7. A method of operating a game structure apparatus, the method comprising:

moving a first block along a first support member until the first block is spaced apart from a second block that is coupled to a second support member adjacent to the first support member such that the first block is rotatable about the first support member;

rotating the first block about the first support member until a desired block face of the first block is oriented in a desired direction; and moving the first block along the first support member until the first block abuts a third block that is coupled to the second support member or a third support member, the second support member and the third support member being adjacent to the first support member; and wherein the first block is capable of moving along and freely rotating about the first support member along the length of the first support member until the first block abuts the second block or the third block.

8. The method according to claim 7, wherein the game structure apparatus includes a frame side including a plurality of rows of blocks with each row of blocks spaced apart from each other at an offset distance and the offset distance is less than a maximum radial diameter required for rotation of one of the blocks in each row of blocks.

9. The method according to claim 7, wherein the first block is rotated subsequent to movement of the first block along the support member.

10. The method according to claim 7, further comprising moving a retention block along a second support member.

11. The method according to claim 10, wherein the retention block is nonrotatable.

12. The method according to claim 10, wherein the first block has a circular bore and the first support member has a circular cross-section such that the first block rotates about the first support member.

* * * * *